US008316749B2

(12) United States Patent
Rimai et al.

(10) Patent No.: US 8,316,749 B2
(45) Date of Patent: Nov. 27, 2012

(54) FINISHER FOR CUTTING OR SCORING RECEIVER

(75) Inventors: Donald S. Rimai, Webster, NY (US); James D. Shifley, Spencerport, NY (US); Brian J. Kwarta, Pittsford, NY (US)

(73) Assignee: Eastman Kodak Company, Rochester, NY (US)

( * ) Notice: Subject to any disclaimer, the term of this patent is extended or adjusted under 35 U.S.C. 154(b) by 380 days.

(21) Appl. No.: 12/779,279

(22) Filed: May 13, 2010

(65) Prior Publication Data

US 2011/0277613 A1 Nov. 17, 2011

(51) Int. Cl.
*B26D 9/00* (2006.01)

(52) U.S. Cl. ..... 83/865; 83/862; 83/879; 83/72; 83/559; 412/16; 412/18

(58) Field of Classification Search ..... 83/862–865, 83/879, 72–76, 255, 360, 368–372, 513, 83/523, 549, 559, 560, 613, 616, 618, 623, 83/904, 934; 412/11–13, 16, 18
See application file for complete search history.

(56) References Cited

U.S. PATENT DOCUMENTS 2,850,803 A 11/1957 Briskman et al.
4,215,609 A 8/1980 Coburn et al.
5,235,882 A * 8/1993 Rabourn ..... 83/76.1
6,099,225 A 8/2000 Allen et al.
6,632,061 B2 * 10/2003 Trovinger ..... 412/11
6,991,224 B2 * 1/2006 Trovinger et al. ..... 270/32
7,819,615 B2 * 10/2010 Trovinger et al. ..... 412/1
2009/0039585 A1 2/2009 Hayashi et al.

OTHER PUBLICATIONS

Oce'Hunkeler roll feeder at internet web site http://global.oce.com/products/hunkeler-roll-feeder/default.aspx
PL265 Fully Automatic Programmable Cutter, Martin Yale Industries at website http://www.martinyale.com/product_details.aspx?SKU=Intimus%20PL215%20&ReturnURL=%2fproduct_listing.aspx%3fCategory%3d1579e4d1-c382-461a-9de0-453e7a74e279%26page%3d1%26pagesize%3d10%26text%3d%26EPCString1%3d%26EPCString2%3d%26EPCString3%3d.
CRICUT Personal Electronic Cutter, Provo Craft on line user manual at website http://www.cricut.com/res/mManual/CricutUserManual.pdf.
GraphicArts Monthly, Reed Business Information, Mar. 2010, "Inline Scoring for Digital Presses" p. 33.
MBMCorp, BC-10 Business Card Cutter Operation Manual, Web site http://www.mbmcorp.com/pdfs/br_0818.pdf.

* cited by examiner

*Primary Examiner* — Phong Nguyen
(74) *Attorney, Agent, or Firm* — Christopher J. White

(57) ABSTRACT

A finisher for a receiver moving in a feed direction includes a cutting device having a cutting blade and a scoring blade on opposite sides of the receiver and oriented perpendicular to the feed direction, and a scoring notch on the opposite side of the receiver from, and parallel to, the scoring blade. An actuator selectively causes the scoring blade to engage the scoring notch as the receiver moves between the scoring blade and scoring notch, so that the receiver is scored, or causes the cutting blade to engage the scoring blade, so that the receiver is cut. A controller receives a job specification including one or more cut or score location(s) on the receiver and causes the receiver to be cut at the cut location(s) or scored at the score location(s).

8 Claims, 9 Drawing Sheets

FINISHER FOR CUTTING OR SCORING RECEIVER

FIELD OF THE INVENTION

This invention pertains to the field of finishing printed sheets, and more particularly to such printed sheets produced using electrophotography.

BACKGROUND OF THE INVENTION

Customers of print jobs can require finishing steps for their jobs. These steps include, for example, folding printed or blank sheets, cutting sheets, scoring sheets, trimming sheets to size and shape, cutting specialty shapes into the edges or interior of a sheet, forming multiple sheets into bound signatures or booklets, binding individual pages or signatures into books, and fastening covers to books by e.g. stapling, saddle-stitching, or gluing. These operations are to be performed on receiver materials of various types, including various thicknesses of paper, for example ranging from India paper to card stock. For example, a number of business cards are printed together on a large sheet of stiff card stock. After printing, individual cards are produced by cutting the sheets of cards into individual business cards.

Conventional finishing equipment is typically not suited for use in consumer occupied environments such as stores or business establishments, and typically requires trained personnel to safely and effectively use it. Cutters typically include large guillotines that use heavy impacts to cut through thick stacks of paper. For example, the INTIMUS PL265 programmable cutter by MARTIN YALE of Wabash, IN cuts up to a 2⅞" stack of paper and weighs 823 lbs. There is a need, therefore, for smaller, lighter finishing equipment to incorporate into devices used by consumers at home or in retail environments. Furthermore, unlike offset presses which run a large number of copies of a single print job, digital printers can produce small numbers of copies of a job, requiring more frequent changes to the finishing sequence. In some cases, each printed page must be finished individually. The PL265 cutter can only store 10 cutting programs, so cannot produce more than 10 cut patterns without manual intervention. There is a need, therefore, for flexible and programmable finishing equipment that can finish each page individually without manual intervention.

Esler describes the CP Bourg BCMe rotary creasing unit, which can score the full width of a receiver sheet in a straight line without stopping the transport of the receiver (Esler, Bill. "Inline scoring for digital presses." *Graphic Arts Monthly* March 2010: 33). However, this device cannot score programmably or across only part of a receiver, and cannot cut sheets.

U.S. Pat. No. 6,099,225 to Allen et al. describes finishing operations performed on a sheet-by-sheet basis using precision paper positioning and a transverse tool carrier. However, this scheme can waste paper due to trimming. Furthermore, this scheme is not well-suited to high-speed operation in which receivers should be moved at a constant velocity through the entire printing and finishing apparatus.

The CRICUT cutter by PROVO CRAFT can cut shapes into individual sheets of paper. However, the machine requires manual loading and unloading. Furthermore, the CRICUT moves the sheet to be cut back and forth during cutting, making it unsuitable for high-volume applications that need continuous-speed sheet transport.

U.S. Pat. No. 2,850,803, issued Sep. 9, 1958 to Briskman et al. and entitled "Shears with arcuate profiled teeth," describes pinking shears which can be used to make scalloped cuts in sheets of paper, or to provide a piece of paper with scalloped edges. However, these shears are strictly manual, and are not suitable for automated use.

There is a continuing need, therefore, for a way of scoring and cutting sheets in small, customizable finishers.

SUMMARY OF THE INVENTION

According to the present invention, there is provided a finisher for a receiver moving in a feed direction, comprising:

a) a cutting device having a cutting blade and a scoring blade disposed on opposite sides of the receiver and oriented perpendicular to the feed direction, and a scoring notch disposed on the opposite side of the receiver from the scoring blade and oriented parallel to the scoring blade;.

b) an actuator for selectively causing the scoring blade to engage the scoring notch in a first position as the receiver moves between the scoring blade and the scoring notch, so that the receiver is scored, or causing the cutting blade to engage the scoring blade in a second position, so that the receiver is cut; and c) a controller for receiving a job specification including one or more cut location(s) or one or more score location(s) on the receiver and causing the actuator to operate in the second position to cut the receiver at the cut location(s) or to operate in the first position to score the receiver at the score location(s).

An advantage of this invention is that it provides programmable, per-receiver or per-sheet control of cutting and scoring. It provides adjustable depth of cut and depth of score. In various embodiments, it cuts or scores without buckling the receiver. It is small and lightweight.

BRIEF DESCRIPTION OF THE DRAWINGS

The above and other objects, features, and advantages of the present invention will become more apparent when taken in conjunction with the following description and drawings wherein identical reference numerals have been used, where possible, to designate identical features that are common to the figures, and wherein.

Figure 1:
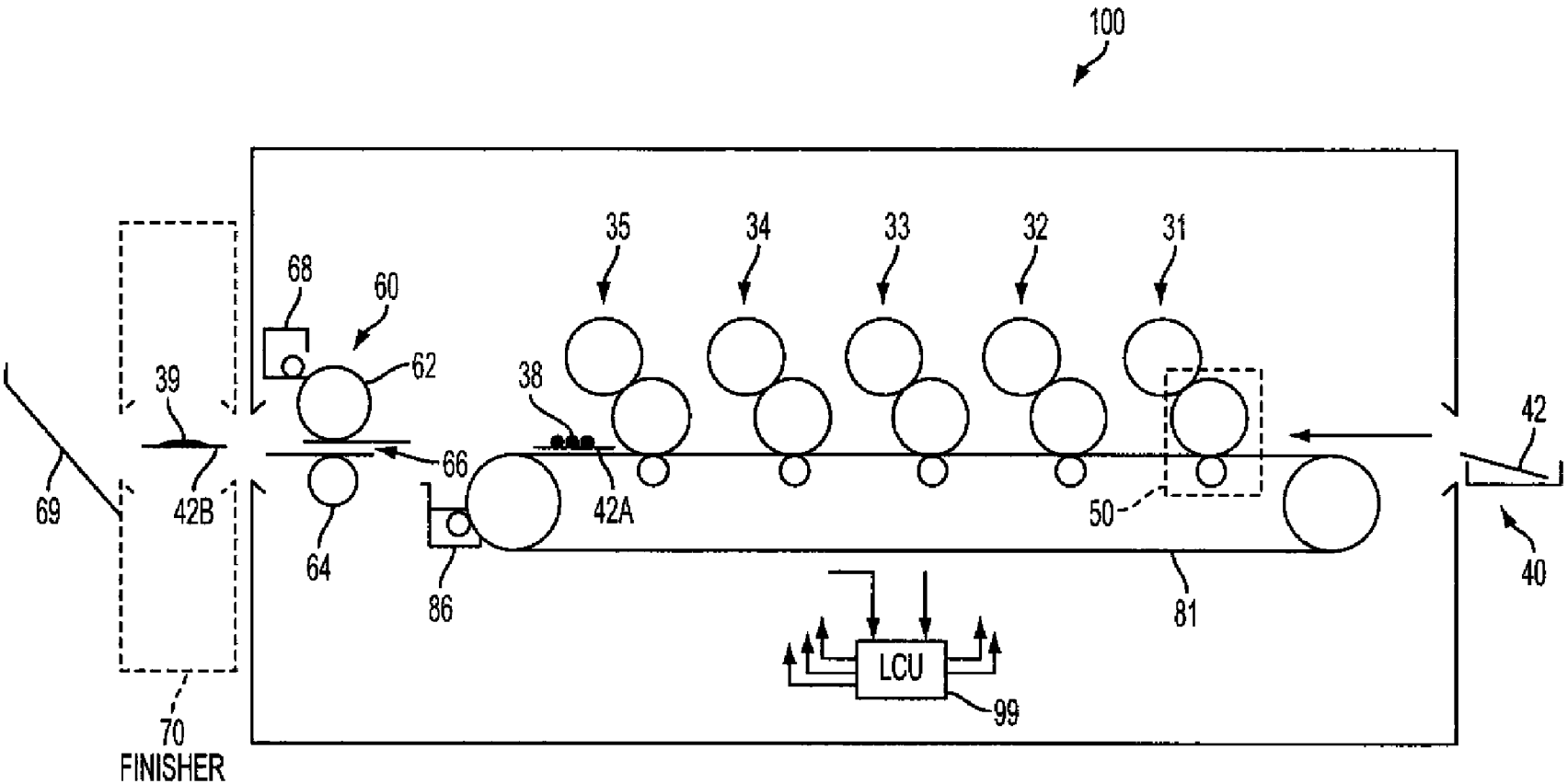
FIG. 1 is an elevational cross-section of an electrophotographic reproduction apparatus suitable for use with this invention.

The attached drawings are for purposes of illustration and are not necessarily to scale.

DETAILED DESCRIPTION OF THE INVENTION

As used herein, the terms "parallel" and "perpendicular" have a tolerance of ±5°.

As used herein, "sheet" is a discrete piece of media, such as receiver media for an electrophotographic printer (described below). Sheets have a length and a width. "Face" refers to one side of the sheet, whether before or after folding.

A computer program product can include one or more storage media, for example; magnetic storage media such as magnetic disk (such as a floppy disk) or magnetic tape; optical storage media such as optical disk, optical tape, or machine readable bar code; solid-state electronic storage devices such as random access memory (RAM), or read-only memory (ROM); or any other physical device or media employed to store a computer program having instructions for controlling one or more computers to practice methods useful with the present invention.

Electrophotography is a useful process for printing images on a receiver (or "imaging substrate"), such as a piece or sheet of paper or another planar medium, glass, fabric, metal, or other objects as will be described below. In this process, an electrostatic latent image is formed on a photoreceptor by uniformly charging the photoreceptor and then discharging selected areas of the uniform charge to yield an electrostatic charge pattern corresponding to the desired image (a "latent image").

After the latent image is formed, charged toner particles are brought into the vicinity of the photoreceptor and are attracted to the latent image to develop the latent image into a visible image. Note that the visible image may not be visible to the naked eye depending on the composition of the toner particles (e.g. clear toner).

After the latent image is developed into a visible image on the photoreceptor, a suitable receiver is brought into juxtaposition with the visible image. A suitable electric field is applied to transfer the toner particles of the visible image to the receiver to form the desired print image on the receiver. The imaging process is typically repeated many times with reusable photoreceptors.

The receiver is then removed from its operative association with the photoreceptor and subjected to heat or pressure to permanently fix ("fuse") the print image to the receiver. Plural print images, e.g. of separations of different colors, are overlaid on one receiver before fusing to form a multi-color print image on the receiver.

Electrophotographic (EP) printers typically transport the receiver past the photoreceptor to form the print image. The direction of travel of the receiver is referred to as the slow-scan or process direction. This is typically the vertical (Y) direction of a portrait-oriented receiver. The direction perpendicular to the slow-scan direction is referred to as the fast-scan or cross-process direction, and is typically the horizontal (X) direction of a portrait-oriented receiver. "Scan" does not imply that. any components are moving or scanning across the receiver; the terminology is conventional in the art.

The electrophotographic process can be embodied in devices including printers, copiers, scanners, and facsimiles, and analog or digital devices, all of which are referred to herein as "printers." Various aspects of the present invention are useful with electrostatogaphic printers such as electrophotographic printers that employ toner developed on an electrophotogaphic receiver, and ionographic printers and copiers that do not rely upon an electrophotographic receiver. Electrophotography and ionography are types of electrostatography (printing using electrostatic fields), which is a subset of electrography (printing using electric fields).

A digital reproduction printing system ("printer") typically includes a digital front-end processor (DFE), a print engine (also referred to in the art as a "marking engine") for applying toner to the receiver, and one or more post-printing finishing system(s) (e.g. a UV coating system, a glosser system, or a laminator system). A printer can reproduce pleasing black-and-white or color onto a receiver. A printer can also produce selected patterns of toner on a receiver, which patterns (e.g. surface textures) do not correspond directly to a visible image. The DFE receives input electronic files (such as Postscript command files) composed of images from other input devices (e.g., a scanner, a digital camera). The DFE can include various function processors, e.g. a raster image processor (RIP), image positioning processor, image manipulation processor, color processor, or image storage processor. The DFE rasterizes input electronic files into image bitmaps for the print engine to print. In some embodiments, the DFE permits a human operator to set up parameters such as layout, font, color, paper type, or post-finishing options. The print engine takes the rasterized image bitmap from the DFE and renders the bitmap into a form that can control the printing process from the exposure device to transferring the print image onto the receiver. The finishing system applies features such as protection, glossing, or binding to the prints. The finishing system can be implemented as an integral component of a printer, or as a separate machine through which prints are fed after they are printed.

The printer can also include a color management system which captures the characteristics of the image printing process implemented in the print engine (e.g. the electrophotographic process) to provide known, consistent color reproduction characteristics. The color management system can also provide known color reproduction for different inputs (e.g. digital camera images or film images).

In an embodiment of an electrophotographic modular printing machine useful with the present invention, e.g. the NEXPRESS 2100 printer manufactured by Eastman Kodak Company of Rochester, N.Y., color-toner print images are made in a plurality of color imaging modules arranged in tandem, and the print images are successively electrostatically transferred to a receiver adhered to a transport web moving through the modules. Colored toners include colorants, e.g. dyes or pigments, which absorb specific wavelengths of visible light. Commercial machines of this type typically employ intermediate transfer members in the respective modules for transferring visible images from the photoreceptor and transferring print images to the receiver. In other electrophotographic printers, each visible image is directly transferred to a receiver to form the corresponding print image.

Electrophotographic printers having the capability to also deposit clear toner using an additional imaging module are also known. The provision of a clear-toner overcoat to a color print is desirable for providing protection of the print from fingerprints and reducing certain visual artifacts. Clear toner uses particles that are similar to the toner particles of the color development stations but without colored material (e.g. dye or pigment) incorporated into the toner particles. However, a clear-toner overcoat can add cost and reduce color gamut of the print; thus, it is desirable to provide for operator/user selection to determine whether or not a clear-toner overcoat will be applied to the entire print. A uniform layer of clear toner can be provided. A layer that varies inversely according to heights of the toner stacks can also be used to establish level toner stack heights. The respective color toners are deposited one upon the other at respective locations on the receiver and the height of a respective color toner stack is the sum of the toner heights of each respective color. Uniform stack height provides the print with a more even or uniform gloss.

FIG. 1 is an elevational cross-section showing portions of a typical electrophotographic printer 100 useful with the present invention. Printer 100 is adapted to produce images, such as single-color (monochrome), CMYK, or pentachrome (five-color) images, on a receiver (multicolor images are also known as "multi-component" images). Images can include text, graphics, photos, and other types of visual content. One embodiment of the invention involves printing using an electrophotographic print engine having five sets of single-color image-producing or -printing stations or modules arranged in tandem, but more or less than five colors can be combined on a single receiver. Other electrophotographic writers or printer apparatus can also be included. Various components of printer 100 are shown as rollers; other configurations are also possible, including belts.

Referring to FIG. 1, printer 100 is an electrophotographic printing apparatus having a number of tandemly-arranged electrophotographic image-forming printing modules 31, 32, 33, 34, 35, also known as electrophotographic imaging subsystems. Each printing module produces a single-color toner image for transfer using a respective transfer subsystem 50 (for clarity, only one is labeled) to a receiver 42 successively moved through the modules. Receiver 42 is transported from supply unit 40, which can include active feeding subsystems as known in the art, into printer 100. In various embodiments, the visible image can be transferred directly from an imaging roller to a receiver, or from an imaging roller to one or more transfer roller(s) or belt(s) in sequence in transfer subsystem 50, and thence to a receiver. The receiver is, for example, a selected section of a web of, or a cut sheet of, planar media such as paper or transparency film.

Each receiver, during a single pass through the five modules, can have transferred in registration thereto up to five single-color toner images to form a pentachrome image. As used herein, the term "pentachrome" implies that in a print image, combinations of various of the five colors are combined to form other colors on the receiver at various locations on the receiver, and that all five colors participate to form process colors in at least some of the subsets. That is, each of the five colors of toner can be combined with toner of one or more of the other colors at a particular location on the receiver to form a color different than the colors of the toners combined at that location. In an embodiment, printing module 31 forms black (K) print images, 32 forms yellow (Y) print images, 33 forms magenta (M) print images, and 34 forms cyan (C) print images.

Printing module 35 can form a red, blue, green, or other fifth print image, including an image formed from a clear toner (i.e. one lacking pigment). The four subtractive primary colors, cyan, magenta, yellow, and black, can be combined in various combinations of subsets thereof to form a representative spectrum of colors. The color gamut or range of a printer is dependent upon the materials used and process used for forming the colors. The fifth color can therefore be added to improve the color gamut. In addition to adding to the color gamut, the fifth color can also be a specialty color toner or spot color, such as for making proprietary logos or colors that cannot be produced with only CMYK colors (e.g. metallic, fluorescent, or pearlescent colors), or a clear toner.

Receiver 42A is shown after passing through printing module 35. Print image 38 on receiver 42A includes unfused toner particles.

Subsequent to transfer of the respective print images, overlaid in registration, one from each of the respective printing modules 31, 32, 33, 34, 35, the receiver is advanced to a fuser 60, i.e. a fusing or fixing assembly, to fuse the print image to the receiver. Transport web 81 transports the print-image-carrying receivers to fuser 60, which fixes the toner particles to the respective receivers by the application of heat and pressure. The receivers are serially de-tacked from transport web 81 to permit them to feed cleanly into fuser 60. Transport web 81 is then reconditioned for reuse at cleaning station 86 by cleaning and neutralizing the charges on the opposed surfaces of the transport web 81.

Fuser 60 includes a heated fusing roller 62 and an opposing pressure roller 64 that form a fusing nip 66 therebetween. In an embodiment, fuser 60 also includes a release fluid application substation 68 that applies release fluid, e.g. silicone oil, to fusing roller 62. Alternatively, wax-containing toner can be used without applying release fluid to fusing roller 62. Other embodiments of fusers, both contact and non-contact, can be employed with the present invention. For example, solvent fixing uses solvents to soften the toner particles so they bond with the receiver. Photoflash fusing uses short bursts of high-frequency electromagnetic radiation (e.g. ultraviolet light) to melt the toner. Radiant fixing uses lower-frequency electromagnetic radiation (e.g. infrared light) to more slowly melt the toner. Microwave fixing uses electromagnetic radiation in the microwave range to heat the receivers (primarily), thereby causing the toner particles to melt by heat conduction, so that the toner is fixed to the receiver.

The receivers (e.g. receiver 42B) carrying the fused image (e.g. fused image 39) are transported in a series from the fuser 60 along a path either to a remote output tray 69, or back to printing modules 31 et seq. to create an image on the backside of the receiver, i.e. to form a duplex print. Receivers can also be transported to any suitable output accessory. For example, an auxiliary fuser or glossing assembly can provide a clear-toner overcoat. Printer 100 can also include multiple fusers 60 to support applications such as overprinting, as known in the art.

In various embodiments, between fuser 60 and output tray 69, receiver 42B passes through finisher 70. Finisher 70 performs various paper-handling operations, such as folding, stapling, saddle-stitching, collating, and binding.

Printer 100 includes main printer apparatus logic and control unit (LCU) 99, which receives input signals from the various sensors associated with printer 100 and sends control signals to the components of printer 100. LCU 99 can include a microprocessor incorporating suitable look-up tables and control software executable by the LCU 99. It can also include a field-programmable gate array (FPGA), programmable logic device (PLD), microcontroller, or other digital control system. LCU 99 can include memory for storing control software and data. Sensors associated with the fusing assembly provide appropriate signals to the LCU 99. In response to the sensors, the LCU 99 issues command and control signals that adjust the heat or pressure within fusing nip 66 and other operating parameters of fuser 60 for receivers. This permits printer 100 to print on receivers of various thicknesses and surface finishes, such as glossy or matte.

Image data for writing by printer 100 can be processed by a raster image processor (RIP; not shown), which can include a color separation screen generator or generators. The output of the RIP can be stored in frame or line buffers for transmission of the color separation print data to each of respective LED writers, e.g. for black (K), yellow (Y), magenta (M), cyan (C), and red (R), respectively. The RIP or color separation screen generator can be a part of printer 100 or remote therefrom. Image data processed by the RIP can be obtained from a color document scanner or a digital camera or produced by a computer or from a memory or network which typically includes image data representing a continuous image that needs to be reprocessed into halftone image data in order to be adequately represented by the printer. The RIP can perform image processing processes, e.g. color correction, in order to obtain the desired color print. Color image data is separated into the respective colors and converted by the RIP to halftone dot image data in the respective color using matrices, which comprise desired screen angles (measured counterclockwise from rightward, the +X direction) and screen rulings. The RIP can be a suitably-programmed computer or logic device and is adapted to employ stored or computed matrices and templates for processing separated color image data into rendered image data in the form of halftone information suitable for printing. These matrices can include a screen pattern memory (SPM).

Further details regarding printer 100 are provided in U.S. Pat. No. 6,608,641, issued on Aug. 19, 2003, by Peter S. Alexandrovich et al., and in U.S. Publication No. 2006/0133870, published on Jun. 22, 2006, by Yee S. Ng et al., the disclosures of which are incorporated herein by reference.

Figure 2:
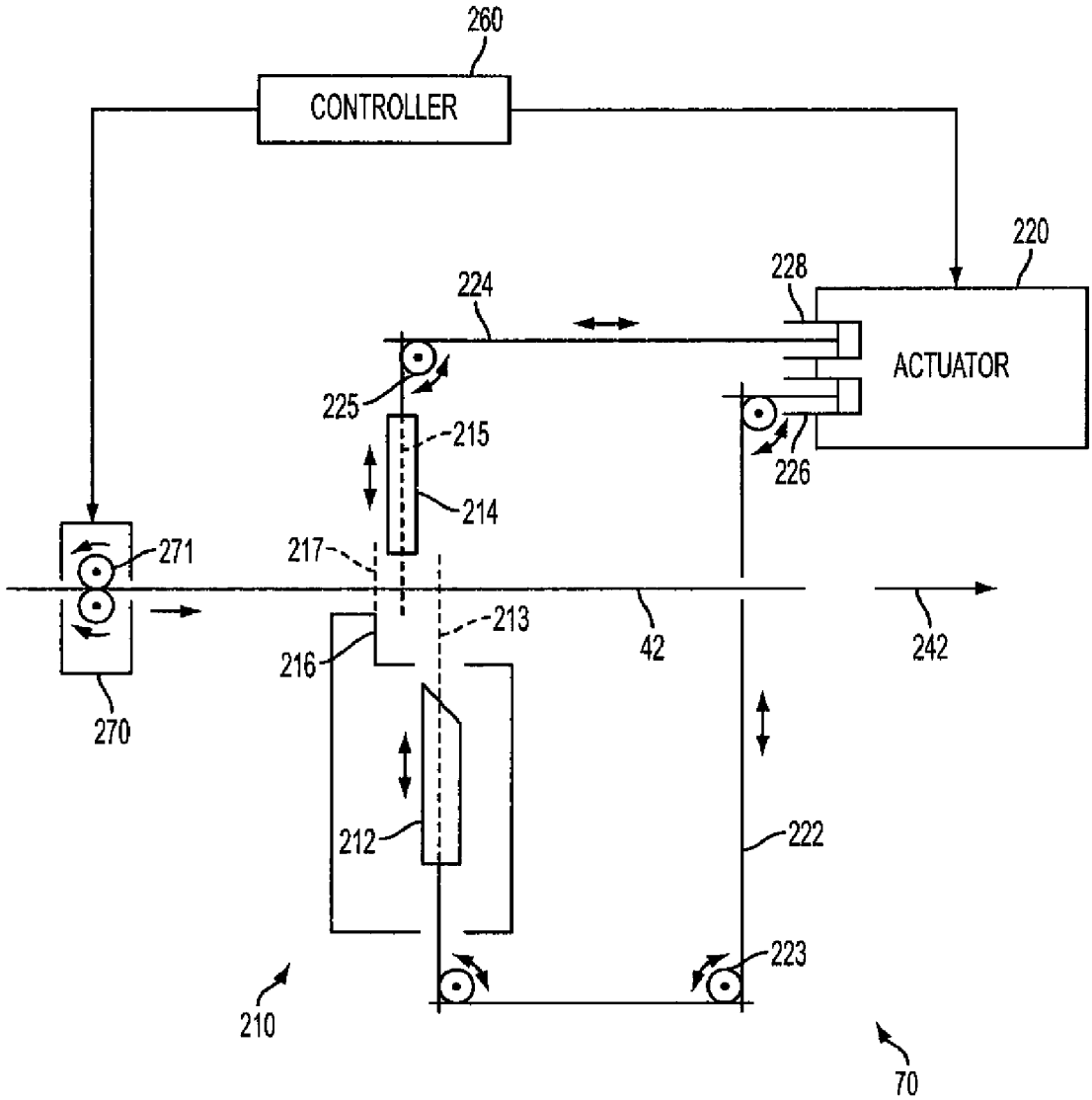
FIG. 2 is an elevational cross-section of a cutting device and related components according to an embodiment of the invention.

FIG. 2 is an elevational cross-section of a cutting device and related components according to an embodiment of the invention. FIG. 2 shows finisher 70 for finishing receiver 42 moving in feed direction 242. Feeder 270 moves receiver 42 in feed direction 242 by rotating rollers 271. The finisher includes cutting device 210 having cutting blade 212 and scoring blade 214. The blades are disposed on opposite sides of receiver 42 and are oriented perpendicular to feed direction 242. Scoring notch 216 is disposed on the opposite side of receiver 42 from scoring blade 214 and is oriented parallel to scoring blade 214. Specifically, orientation 213 of cutting blade 212, orientation 215 of scoring blade 214, and orientation 217 of scoring notch 216 are parallel, and are all perpendicular to feed direction 242. Actuator 220 is adapted to move cutting blade 212 and scoring blade 214 up and down. Piston 226 is connected through rack 222 and pinions (as shown, e.g. pinion 223) so that when piston 226 pushes out, cutting blade 212 moves up, and when piston 226 pulls in, cutting blade 212 moves down. Similarly, piston 228 is connected to rack 224 and pinions (as shown, e.g. pinion 225) so that when it pushes or pulls, scoring blade 214 moves down or up, respectively. Other structures for permitting actuator 220 to move cutting blade 212 and scoring blade 214 up and down will be obvious to those skilled in the mechanical art. For example, belts and pulleys, linear motors, helical slides, camshafts and rocker arms, and other arrangements can be used.

Actuator 220 is effective in two positions: a first position in which receiver 42 is scored, and a second position in which receiver 42 is cut. These positions are engaged selectively at the direction of controller 260, discussed below. The first and second positions of actuator 220 include e.g. piston or cam positions or orientations, which are directly related to the positions of cutting blade 212 and scoring blade 214 with respect to each other and receiver 42.

Controller 260 receives a job specification including one or more cut location(s) or one or more score location(s) on receiver 42. As receiver 42 moves through finisher 70, controller 260 interprets the job specification and causes actuator 220 to operate in the second position to cut the receiver at the cut location(s) or to operate in the first position to score the receiver at the score location(s). Controller 260 can be an ASIC, FPGA, DSP, PLD, or general-purpose processor, and can employ a computer program to control its operation. Given the system as described according to the invention herein, software not specifically shown, suggested, or described herein that is useful for implementation of the invention is conventional and within the ordinary skill in such arts.

Figure 3:
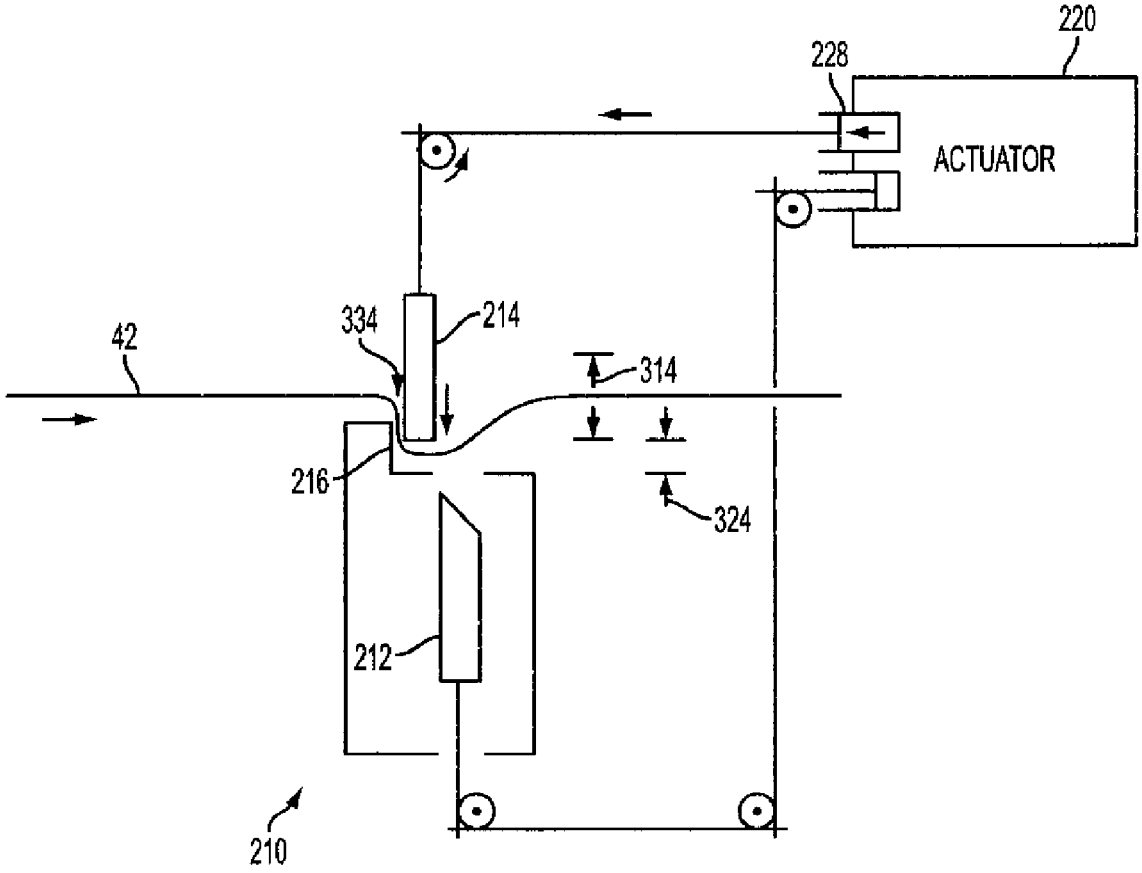
FIG. 3 is an elevational cross-section of the apparatus shown in FIG. 2 in a first position.

FIG. 3 is an elevational cross-section of the apparatus shown in FIG. 2 in a first position. Actuator 220, piston 228, scoring blade 214, receiver 42, scoring notch 216, cutting blade 212, and cutting device 210 are as shown in FIG. 2.

In the first position, actuator 220 causes scoring blade 214 to engage scoring notch 216 as receiver 42 moves between scoring blade 214 and scoring notch 216, so that the receiver is scored at score location 334. In an embodiment, actuator 220 is operative in the first position to move scoring blade 214 towards receiver 42 to cause scoring blade 214 to engage scoring notch 216. Scoring blade 214 moves a distance shown as travel 314. In an embodiment, the bottom of scoring blade 214 does not touch the bottom of scoring notch 216, but is separated from it by standoff height 324. Standoff height 324 is preferably selected based on the thickness of receiver 42: for thicker receivers, larger standoff heights are used.

Figure 4:
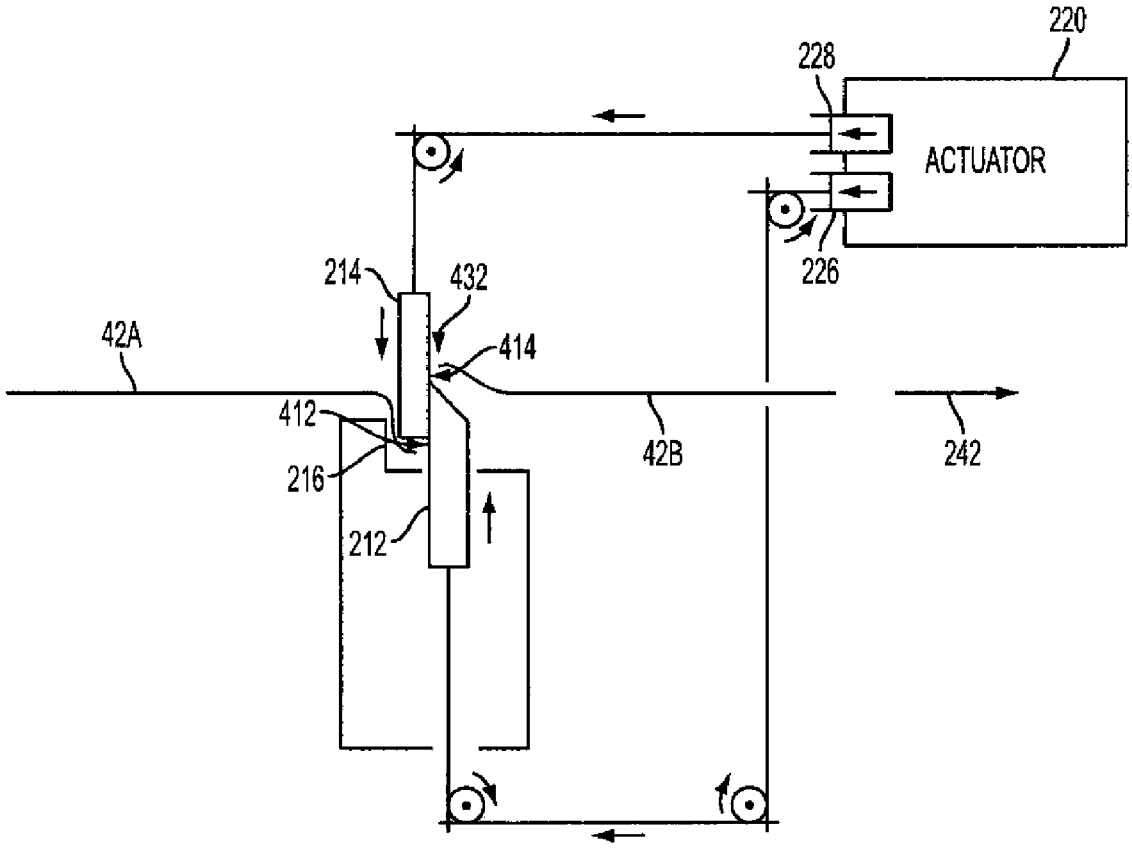
FIG. 4 is an elevational cross-section of the apparatus shown in FIG. 2 in a second position.

FIG. 4 is an elevational cross-section of the apparatus shown in FIG. 2 in a second position. Actuator 220, piston 228, piston 226, scoring blade 214, teed direction 242, scoring notch 216, and cutting blade 212 are as shown in FIG. 2.

Actuator 220 is effective in a second position to cause cutting blade 212 to engage scoring blade 214, so that the receiver is cut at cut location 432. Receiver 42A is shown before cut location 432 in feed direction 242, and receiver 42B is shown after cut location 432.

In an embodiment, actuator 220 is operative in the second position to move scoring blade 214 towards receiver 42A to cause it to engage cutting blade 212. Actuator 220 also moves cutting blade 212 towards receiver 42A to cause it to engage scoring blade 214.

In an embodiment, scoring blade 214 and cutting blade 212 are disposed laterally adjacent to each other along feed direction 242. When actuator 220 is in the second position and scoring blade 214 and cutting blade 212 are engaged, cutting face 412 of cutting blade 212 shears against cutting face 414 of scoring blade 214 to cut receiver 42A. This advantageously provides self-sharpening action: each time receiver 42A is cut, cutting face 412 is sharpened by cutting face 414.

In preferred embodiments, the bulk or surface of scoring blade 214 is harder than the bulk or surface of cutting blade 212 where the blades contact while cutting receiver 42A. This provides improved self-sharpening action.

While receiver 42 is being scored or cut (as shown in FIGS. 3 and 4, respectively), friction is applied to receiver 42 which tends to impede its motion in feed direction 242. If the time when blades 212, 214 are in contact with receiver 42 is small, receiver 42 will buckle (buckle 555, FIG. 5) slightly before score location 334 or cut location 432 in feed direction 242, then unbuckle when the blades 212, 214 retract.

Figure 5:
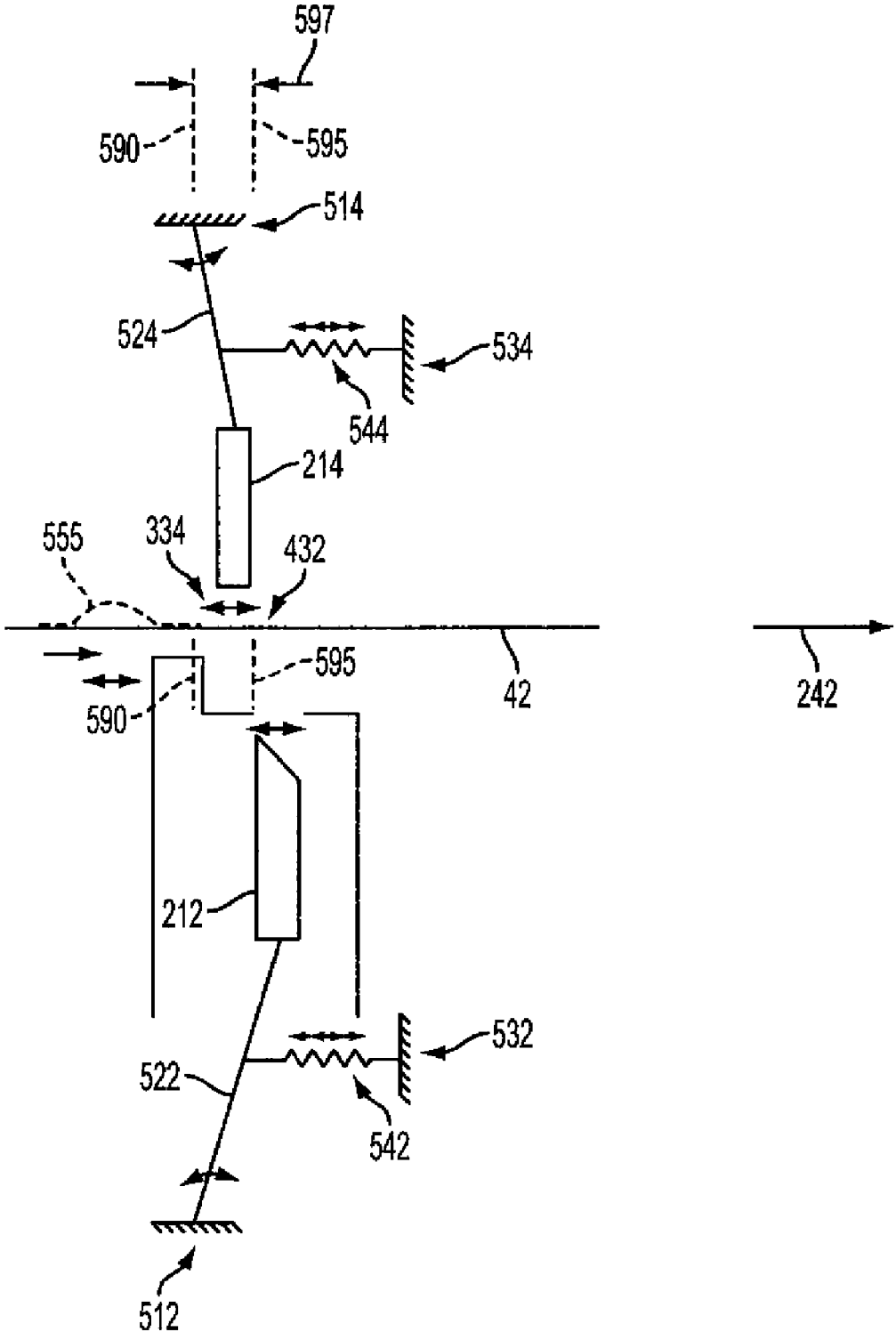
FIG. 5 is an elevational cross-section of a cutting device and mounting components according to an embodiment of the invention.

FIG. 5 is an elevational cross-section of a cutting device and mounting components according to an embodiment of the invention which reduces buckle of receiver 42. Scoring blade 214, receiver 42, feed direction 242, and cutting blade 212 are as shown in FIG. 2. Score location 334 and cut location 432 are as shown in FIGS. 3 and 4, respectively.

Finisher 70 includes a structure for mounting cutting device 210 so that during a cutting operation (i.e. a cut or score), cutting device 210 can translate (move) in feed direction 242 to reduce buckling of moving receiver 42. A specific embodiment is shown in FIG. 5, but other embodiments of translating or pivoting motion can be employed. For example, cutting device 210 can be mounted on a slide, belt, piston, or other linear positioning system. Energy to move cutting device 210 can be provided by a motor or servomotor, drive, or piezoelectric actuator, or, as in FIG. 5, by the kinetic energy of moving receiver 42.

FIG. 5 shows cutting device 210 translated in feed direction 242 away from its rest position 590. The center of cutting device 210 in feed direction 242 is at offset position 595.

When receiver 42 is not moving and cutting device 210 is in its rest position, the center of cutting device 210 is at rest position 590. Offset 597 is the amount by which cutting device 210 has moved away from its rest position.

In an embodiment, the mounting structure includes scoring mount 514 for holding scoring blade 214, and cutting mount 512 for holding cutting blade 212. Scoring beam 524 connects scoring blade 214 to scoring mount 514, and cutting beam 522 connects cutting blade 212 to cutting mount 512. Scoring beam 524 is disposed so that scoring blade 214 is mechanically supported by scoring mount 514 through scoring beam 524. Cutting beam 522 is disposed so that scoring notch 216 (shown in FIGS. 3 and 4) and cutting blade 212 are mechanically supported by cutting mount 512 through cutting beam 522. Beams 522, 524 can be rigid or flexible, and mounts 512, 514 can be movable or stationary, respectively. In an embodiment, flexible beams 522, 524 are mounted on rigid, fixed mounts 512, 514. In another embodiment, rigid beams 522, 524 are mounted with bearings on rigid, fixed mounts 512, 514. The bearings (not shown) permit the rigid beams to rotate around their mount points, where the bearings are. Other ways of assembling blades 212, 214, beams 522, 524, and mounts 512, 514 will be obvious to those skilled in the mechanical art.

In another embodiment, the mounting structure further includes springs. Scoring spring seat 534 is connected by scoring spring 544 to scoring beam 524. Cutting spring seat 532 is connected by cutting spring 542 to cutting beam 522. Cutting device 210 is therefore driven, when one or more of the blades 212, 214 is engaged, by the kinetic energy of moving receiver 42, and is damped by springs 542, 544. Scoring spring seat 534, scoring spring 544, cutting spring seat 532, cutting spring 542, scoring beam 524, cutting beam 522, scoring blade 214, and cutting blade 212 thus form an oscillating system that oscillates about scoring mount 514 and cutting mount 512. As described above, various combinations of rigid and flexible members, and of stationary and movable members, can be employed to produce this oscillating system.

In an embodiment, scores and cuts are only permitted at certain locations in feed direction 242, which can be the in-track direction of printer 100 (FIG. 1). For example, scores and cuts can be permitted every 1 cm. The oscillating system is designed so that the time receiver 42 requires to move 1 cm is the time required for cutting device 210 to spring back into position.

Figure 8:
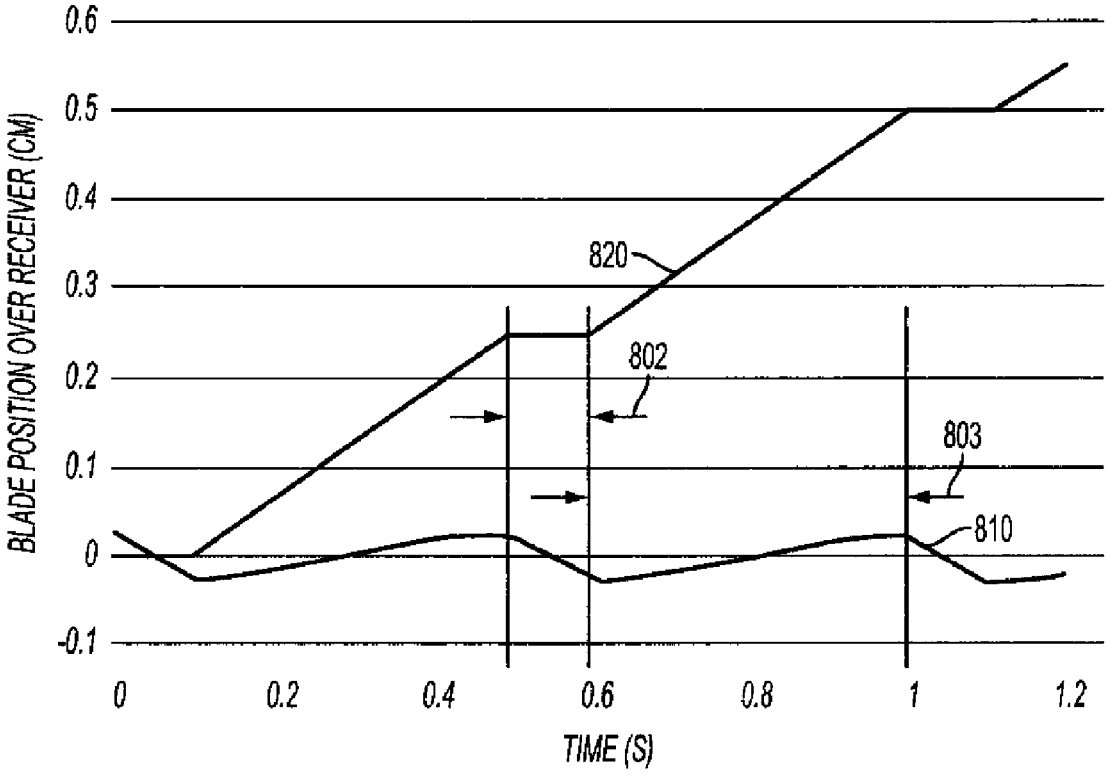
FIG. 8 is a simulated plot illustrating the operation of oscillating cutting devices according to various embodiments of the invention.

Referring to FIG. 8, and also to FIGS. 2 and 5, there is shown a simulated plot illustrating the operation of oscillating cutting devices according to various embodiments of the invention, such as that shown in FIG. 5. The abscissa is time and the ordinate is the relative position of cutting device 210 over receiver 42. Higher ordinate values are closer to the trailing edge of receiver 42; zero is rest position 590 of cutting device 210 (e.g. the position shown in FIGS. 2-4), and the leading edge of receiver 42. This plot is calculated using a 0.25 cm grid of permissible cuts/scores, a receiver speed in feed direction 242 of 0.5 cm/s, and a time of 0.1 s required to cut or score. Therefore the blades 212, 214 move with the paper 0.05 cm in the 0.1 s they require to cut or score, then release and begin to oscillate.

Curve 810 shows the position of the center of cutting device 210 in feed direction 242 with respect to its rest position 590 as receiver 42 moves. That is, curve 810 shows offset 597. During cutting time 802, the blades 212, 214 are engaged with receiver 42 and so move with it. During release time 803, cutting device 210 is free to oscillate. One skilled in the art can select beams, mounts, springs, and other components (discussed above with reference to FIG. 5) so that one half-period of oscillation is the time for the next grid point to arrive under the blades (here, 0.4 s). Therefore cutting device 210 is always correctly positioned for each cut, and can make the cuts without any buckling of receiver 42.

Curve 820 shows the position of the center of cutting device 210 with respect to the leading edge of receiver 42 as receiver 42 moves. The first cut is made at the leading edge, e.g. to separate one sheet from another (see FIG. 4) in a roll-fed system. Subsequent cuts (or scores) are made at successive grid points, here 0.25 cm and 0.5 cm.

Figure 6A:
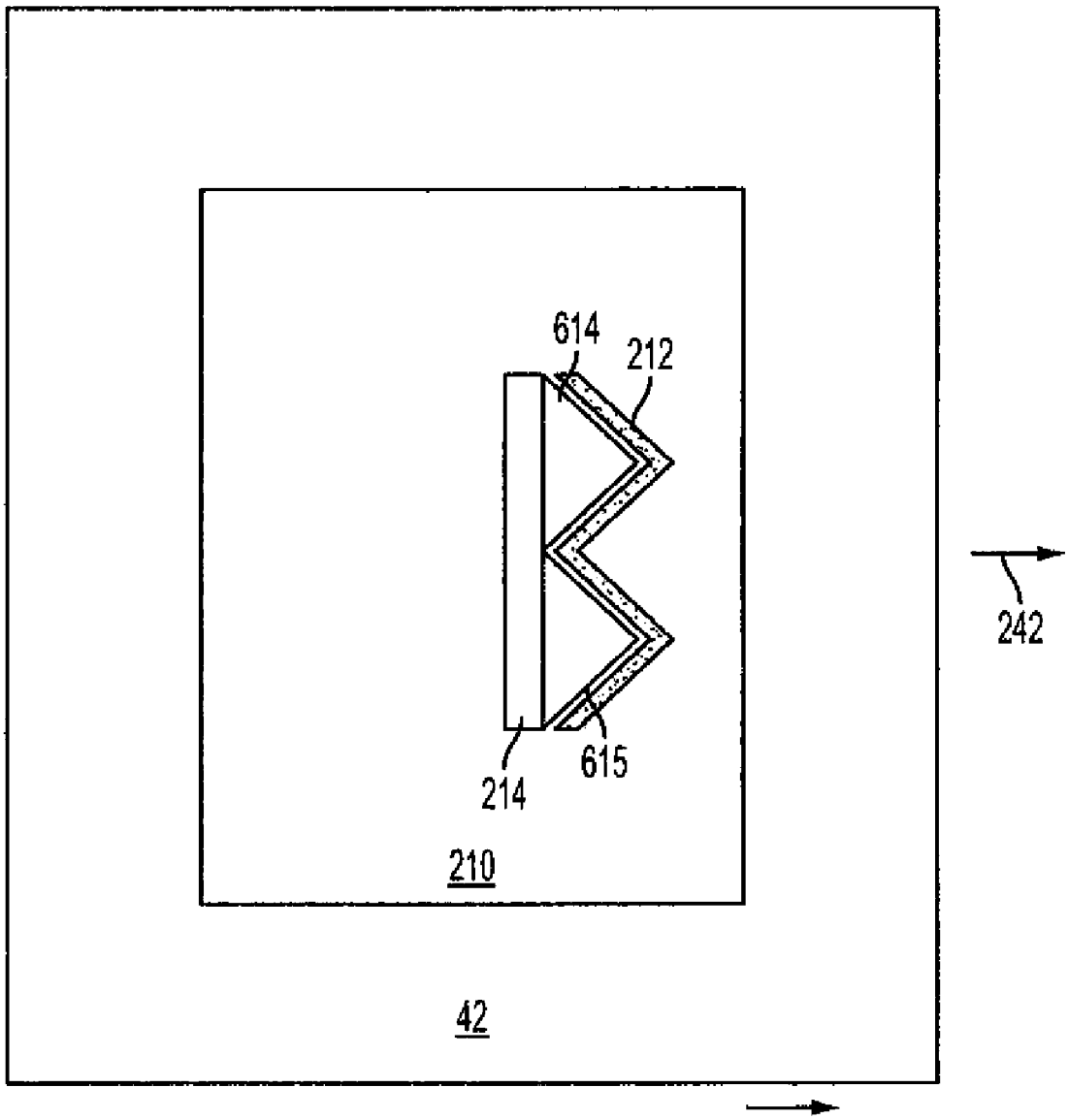
FIGS. 6A and 6B are a plan view and an elevational cross-section, respectively, of a cutting device and related components according to an embodiment of the invention.
Figure 6B:
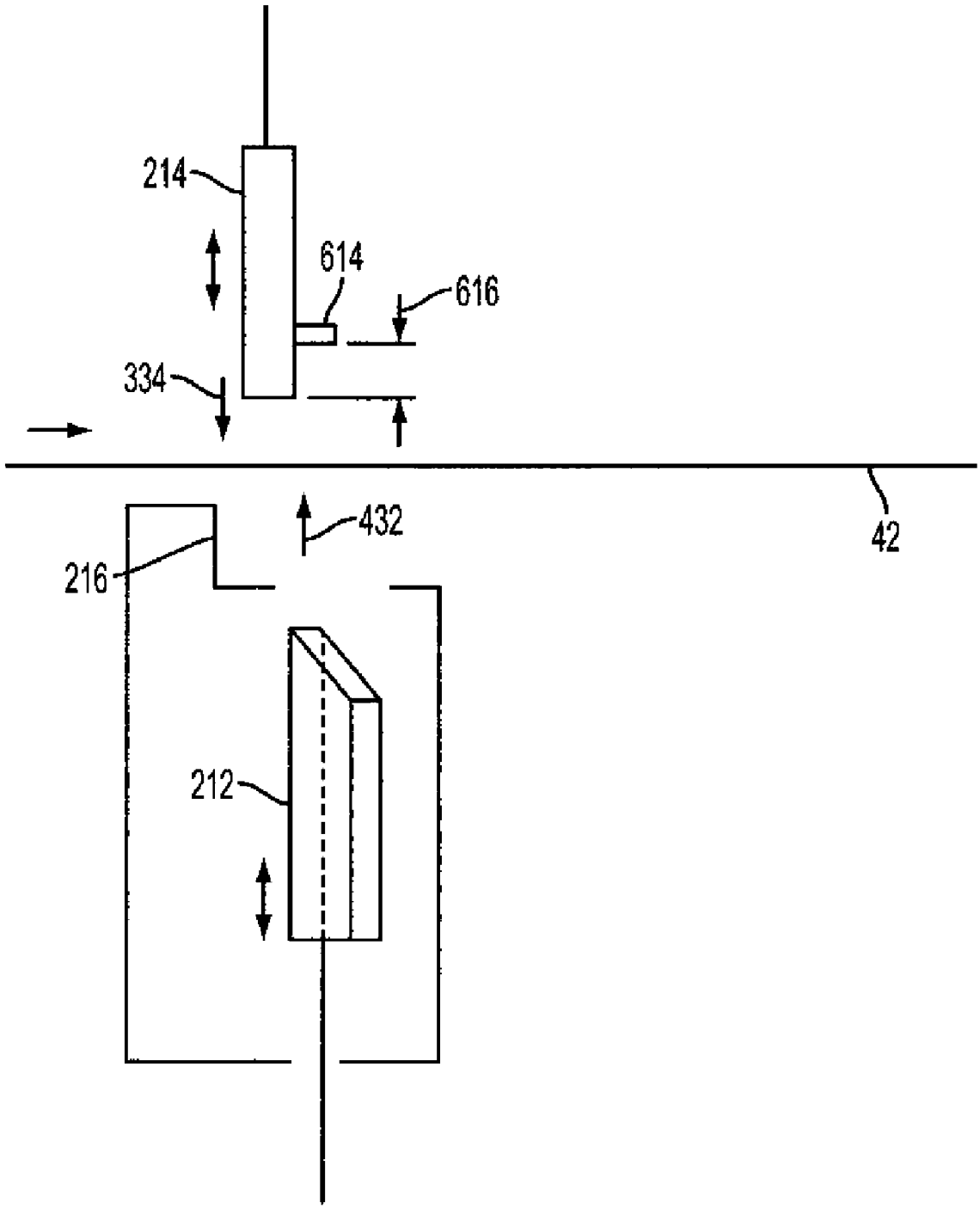

FIGS. 6A and 6B are a plan view and an elevational cross-section, respectively, of a cutting device and related components according to an embodiment of the invention using a shaped cutting blade. This embodiment can provide pinking and other edge shapes, and shaped cuts within receiver 42. Cutting device 210 includes scoring blade 214 and cutting blade 212, as shown in FIG. 2. Unlike FIG. 2, however, in this embodiment the cutting blade is shaped, i.e. not substantially straight. For example, the shape of the cutting blade perpendicular to the face of receiver 42 when cutting device 210 is in its rest position 590 (FIG. 5) can be described by a piecewise continuous function which is not a straight line, a piecewise-linear continuous function such as the "w" shape shown in FIG. 6A, a non-linear function such as a sinusoidal function or the floor function, or a continuous, periodic function describable as a Fourier series, e.g. a ramp or sawtooth. In this way, a cut is made in receiver 42 that is not substantially a straight line. In an embodiment, at least one point on the cut in receiver 42 is at least 2 mm from at least one point on the line connecting the endpoints of the cut.

FIG. 6A shows cutting blade 212 shaped like a "w" rotated 90° counterclockwise. Cutting device 210 further includes pinking blade 614. Pinking blade 614 has a cutting edge 615 adapted to mate with shaped cutting blade 212. Therefore, when cutting blade 212 engages pinking blade 614, receiver 42 is cut in the shape of cutting blade 212.

Pinking blade 614 is shown here on the trailing edge of scoring blade 214 (that is, on the side indicated by feed direction 242). In another embodiment, pinking blade 614 is on the leading edge of scoring blade 214, so that receiver 42 is pinked before it is scored. Cutting device 210 scores while cutting, so pinking blade 614 is preferably on the side of scoring blade 214 closer to the center of receiver 42. This advantageously permits pinking the edges of receiver 42 without introducing undesired scores next to the cuts.

FIG. 6B shows an elevational cross-section of the embodiment of FIG. 6A. Scoring blade 214, score location 334, receiver 42, cut location 432, scoring notch 216, and cutting blade 212 are as shown in FIGS. 2-4.

Pinking blade 614 is affixed to the side of scoring blade 214 a selected non-zero distance 616 from the end of scoring blade 214 that engages scoring notch 216. Therefore, after cutting blade 212 engages scoring blade 214, cutting blade 212 or scoring blade 214 continues moving so that cutting blade 212 engages pinking blade 614 and the receiver 42 is cut in the shape of cutting blade 212.

Figure 7:
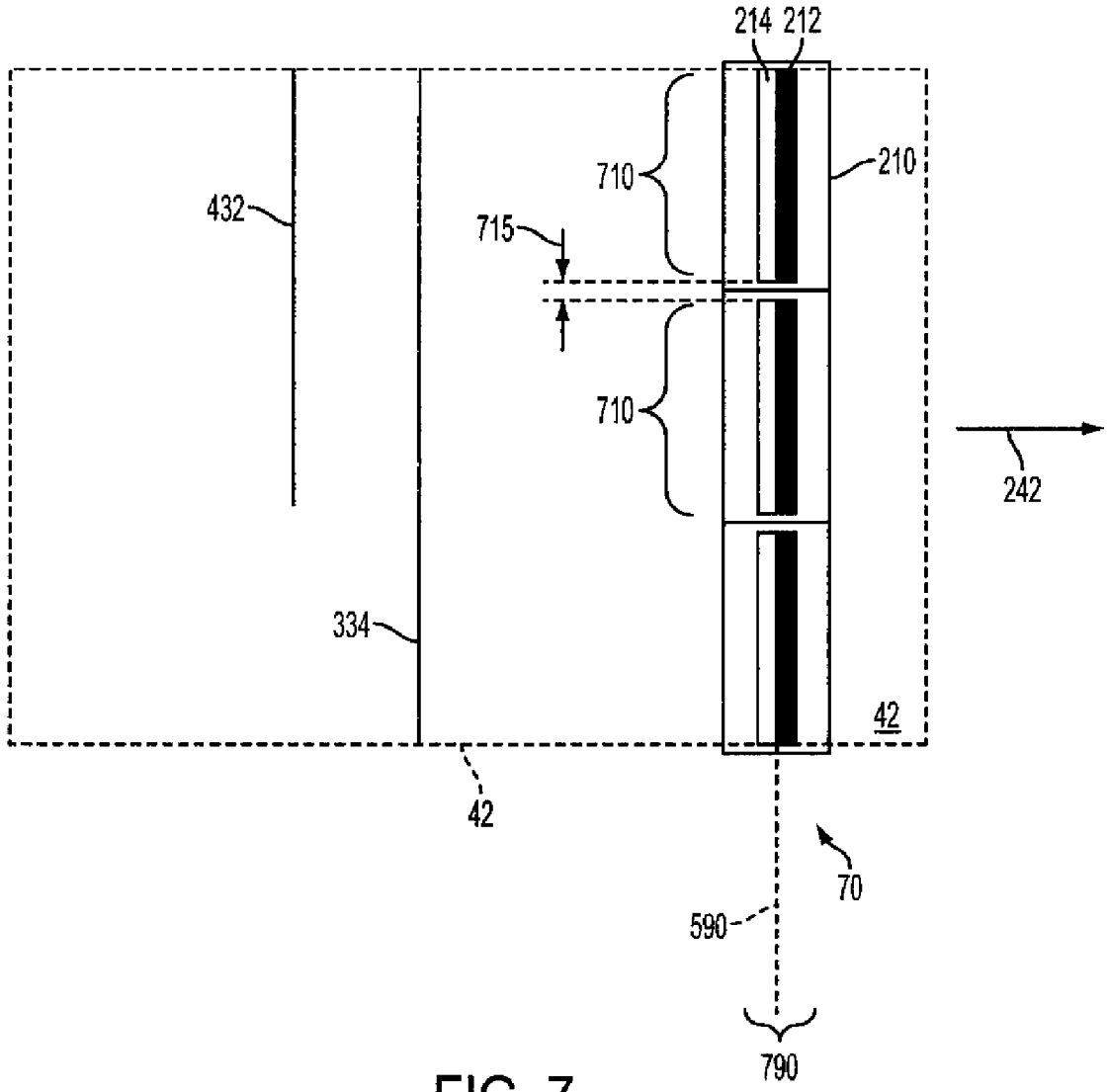
FIG. 7 is a plan view of multiple cutting devices according to an embodiment of the invention.

FIG. 7 is a plan view of multiple cutting devices according to an embodiment of the invention. Finisher 70, receiver 42, feed direction 242, cutting blade 212, and scoring blade 214 are as shown in FIG. 2. Finisher 70 includes a plurality of cutting devices 210 arranged along a line perpendicular to the feed direction. By "arranged along a line" it is meant that the centers of cutting devices 210 are within a ±1 mm band extended perpendicular to the direction of motion 242 of receiver 42, and that the center of each cutting device is within ±0.5 mm, and preferably within ±0.25 mm, of the center of any adjacent cutting device, measured in direction of motion 242. For example, rest position 590 at the center of the bottom cutting device is shown defining the center of ±1 mm band 790. Each cutting device 210 is preferably oriented (orientations 213, 215, 217; FIG. 2) perpendicular to feed direction 242. Perpendicular orientation advantageously reduces the probability of dragging receiver 42 under scoring blade 214.

Each cutting device 210 has a respective cutting area 710 in which is cuts or scores receiver 42. Cutting area 710 is preferably ¼"-1" long. Each end of the cutting area 710 of each cutting device 210 is less than or equal to 1 mm away from the adjacent end of the cutting area of the adjacent cutting device 210. That is, distance 715 is less than or equal to 1 mm. Distance 715 is preferably zero.

An example of score location 334, and an example of cut location 432, are shown. Scores and cuts can extend part-way or all the way across receiver 42, to permit e.g. the automated production of pre-cut origami and paper airplane stock.

Individual cutting devices 210 can be activated simultaneously or sequentially. Sequential activation can reduce the force on receiver 42 while it is being scored or cut.

Multiple rows of cutting devices 210 can be provided. In an embodiment, a row is provided at the leading edge of receiver 42 in feed direction 242. The leading-edge row has pinking blades 614 pointing away from feed direction 242. Another row is provided at the trailing edge of receiver 42. The trailing-edge row has pinking blades 614 pointing towards feed direction 242. This permits pinking leading and trailing edges without introducing undesired scores.

Multiple rows of cutting devices 210 can also be provided to score first, and then cut. This advantageously reduces the cutting force required on thick receivers 42. Alternatively, receiver 42 can be stopped and held in position while a single row of cutting devices 210 sequentially scores and cuts.

In various embodiments, cutting blade 212 and scoring blade 214 can have the same widths or different widths. Finisher 70 can also include a rotating-wheel or other slitter for making longitudinal cuts. Cuts can extend all the way through receiver 42 or only part-way, and scores can be of various depths. Multiple receivers 42 stacked or fastened together vertically can be finished, and cut or score depth can be adjusted to cut at least one of the stacked receivers 42 and to not cut at least one other of the stacked receivers 42. This enables automated production of Advent calendars.

Cutting blade 212 or scoring blade 214 can include cutting wheels rotatable to various positions to obtain desired effects. For example, a cutting wheel can include a blade with protrusions adapted to perforate receiver 42, and a blade with no protrusions adapted to cut receiver 42. The cutting wheel can be rotated before the actuator causes the blades 212, 214 to engage. In this way, cutting and perforating can be selected. Cutting blade 212 can be shaped like an ulu blade or guillotine blade to reduce the force required (an ulu blade is described in U.S. Pat. No. 5,347,718, issued Sep. 20, 1994 to Turner, the disclosure of which is incorporated herein by reference). Specifically, cutting blade 212 can contact receiver 42 first at a small number of points, then at additional points as it continues its travel toward receiver 42.

The invention is inclusive of combinations of the embodiments described herein. References to "a particular embodiment" and the like refer to features that are present in at least one embodiment of the invention. Separate references to "an embodiment" or "particular embodiments" or the like do not necessarily refer to the same embodiment or embodiments; however, such embodiments are not mutually exclusive, unless so indicated or as are readily apparent to one of skill in the art. The use of singular or plural in referring to the "method" or "methods" and the like is not limiting. The word "or" is used in this disclosure in a non-exclusive sense, unless otherwise explicitly noted.

The invention has been described in detail with particular reference to certain preferred embodiments thereof, but it will be understood that variations, combinations, and modifications can be effected by a person of ordinary skill in the art within the spirit and scope of the invention.

PARTS LIST

31, 32, 33, 34, 35 printing module
38 print image
39 fused image
40 supply unit
42, 42A, 42B receiver
50 transfer subsystem
60 fuser
62 fusing roller
64 pressure roller
66 fusing nip
68 release fluid application substation
69 output tray
70 finisher
81 transport web
86 cleaning station
99 logic and control unit (LCU)
100 printer
210 cutting device
212 cutting blade
213 orientation
214 scoring blade
215 orientation
216 scoring notch
217 orientation
220 actuator
222 rack
223 pinion
224 rack
225 pinion
226, 228 piston
242 feed direction
260 controller
270 feeder
271 rollers
314 travel
324 standoff height
334 score location
412 cutting face
414 cutting face
432 cut location
512 cutting mount
514 scoring mount
522 cutting beam
524 scoring beam
532 cutting spring seat
534 scoring spring seat
542 cutting spring
544 scoring spring
555 buckle
590 rest position
595 offset position
597 offset
614 pinking blade
615 cutting edge
616 distance
710 cutting area

715 distance
790 band
802 cutting time
803 release time
810 curve
820 curve

The invention claimed is:

1. A finisher for a receiver moving in a feed direction, comprising:

a) a cutting device having a cutting blade and a scoring blade disposed on opposite sides of the receiver and oriented perpendicular to the feed direction, and a scoring notch disposed on the opposite side of the receiver from the scoring blade and oriented parallel to the scoring blade;

b) an actuator for selectively causing the scoring blade to engage the scoring notch in a first position as the receiver moves between the scoring blade and the scoring notch, so that the receiver is scored, or causing the cutting blade to engage the scoring blade in a second position, so that the receiver is cut; and c) a controller for receiving a job specification including one or more cut location(s) or one or more score location (s) on the receiver and causing the actuator to operate in the second position to cut the receiver at the cut location (s) or to operate in the first position to score the receiver at the score location(s), wherein the scoring blade and the cutting blade are disposed laterally adjacent to each other along the feed direction, so that when the scoring blade and the cutting blade are engaged, a cutting face of the cutting blade shears against a cutting face of the scoring blade to cut the receiver.

2. The finisher according to claim 1, wherein:

the actuator is operative in the first position to move the scoring blade towards the receiver to cause it to engage the scoring notch; and the actuator is operative in the second position to move the scoring blade towards the receiver to cause it to engage the cutting blade and to move the cutting blade towards the receiver to cause it to engage the scoring blade.

3. The finisher according to claim 1, wherein the surface of the scoring blade is harder than the surface of the cutting blade where the blades contact while cutting the receiver.

4. The finisher according to claim 1, further includes means for mounting the cutting device so that during a cutting operation, the cutting device can translate in the feed direction to reduce buckling of the moving receiver.

5. The finisher according to claim 4, wherein the mounting means includes:

i) a scoring mount and a cutting mount;

ii) a scoring beam disposed so that the scoring blade is mechanically supported by the scoring mount through the scoring beam; and iii) a cutting beam disposed so that the scoring notch and cutting blade are mechanically supported by the cutting mount through the cutting beam.

6. The finisher according to claim 5, wherein the mounting means further includes a scoring spring seat, a scoring spring connecting the scoring beam to the scoring spring seat, a cutting spring seat, and a cutting spring connecting the cutting beam to the cutting spring seat, so that the scoring spring seat, scoring spring, cutting spring seat, cutting spring, scoring beam, cutting beam, scoring blade and cutting blade form an oscillating system that oscillates about the scoring mount and the cutting mount.

7. The finisher according to claim 1, wherein the cutting blade is shaped, and further including a pinking blade having a cutting edge adapted to mate with the shaped cutting blade and affixed to the side of the scoring blade a selected non-zero distance from the end of the scoring blade that engages the scoring notch, so that when the cutting blade engages the scoring blade, the receiver is cut in the shape of the cutting blade.

8. A finisher for a receiver moving in a feed direction, comprising a plurality of cutting devices according to claim 1 arranged along a line perpendicular to the feed direction, wherein each cutting device has a respective cutting area, and each end of the cutting area of each cutting device is less than or equal to 1 mm away from the adjacent end of the cutting area of the adjacent cutting device.

* * * * *